United States Patent [19]

Craft

[11] Patent Number: 4,639,985

[45] Date of Patent: Feb. 3, 1987

[54] SNAP-IN CASKET DISH

[75] Inventor: William K. Craft, Cincinnati, Ohio

[73] Assignee: Batesville Casket Company, Inc., Batesville, Ind.

[21] Appl. No.: 622,303

[22] Filed: Jun. 19, 1984

[51] Int. Cl.[4] ..... A61G 17/00; E04F 19/02

[52] U.S. Cl. ..... 27/19; 24/293; 24/616

[58] Field of Search ..... 27/14, 17, 19; 24/458, 24/462, 615, 616, 289, 293, 294, 295; 248/205.1, 316.7, 221.4, 225.1; 211/89, 119.11; 52/710, 773

[56] References Cited

U.S. PATENT DOCUMENTS

| | | | |
|---|---|---|---|
| 2,423,402 | 7/1947 | Olsen | 135/5 |
| 2,718,687 | 9/1955 | Woltering et al. | 27/19 |
| 2,964,824 | 12/1960 | Hillenbrand | 27/19 |
| 2,968,072 | 1/1961 | Bright | 49/491 |
| 3,081,504 | 3/1963 | Bohnsack | 52/400 |
| 3,228,085 | 1/1966 | Nelson | 27/19 |
| 3,316,608 | 5/1967 | Ross | 27/19 |
| 3,432,609 | 3/1969 | Duvall et al. | 174/35 |
| 3,486,788 | 12/1969 | Benton | 296/120 |
| 3,707,815 | 1/1973 | Molyneux | 52/213 |
| 3,720,438 | 3/1973 | Johnson et al. | 296/23 R |

*Primary Examiner*—Robert E. Bagwill
*Assistant Examiner*—Terrence L. B. Brown
*Attorney, Agent, or Firm*—Brian J. Leitten

[57] ABSTRACT

A snap-in, flexible casket dish or puffing for the lids of caskets allows for rapid and accurate insertion and replacement without special tools. A flexible channel member is attached to the interior of the casket lid and releasably retains flexible edges of the casket dish or puffing.

6 Claims, 9 Drawing Figures

SNAP-IN CASKET DISH

BACKGROUND AND OBJECTS OF THE INVENTION

The present invention relates to burial caskets and, in particular, to the dish or puffing positioned in the interior of a casket cap or lid.

The interior of a burial casket is typically lined with a covering material, e.g., an upholstered fabric lining material. In the interior of the casket cap or lid, this lining material is often secured to or mounted on a dish which has traditionally comprised a central panel surrounded by a framing. The dish is commonly referred to as "puffing". The upholstery is available in a variety of colors and patterns. The dish is generally of cardboard or chip board construction, and consists of a plurality of parts physically secured together to form a shaped body generally conforming to the shape of the interior of the casket lid.

In the past, mounting the fabric-lined casket dish to the casket lid has been a difficult, time-consuming and expensive procedure. Prior techniques for accomplishing placement of the casket dish have involved, e.g., stapling or otherwise securing a plastic channel into a cooperating groove or channel formed in the rim of the casket lid or cap. After insertion of the plastic channel into the lid, the edges or flaps of the casket dish were inserted into the plastic channel. To insure that the casket dish was retained in the casket lid, a gimp, i.e., a generally cylindrical-shaped rope-like strip typically formed of rubber or paper, was then pressed into the channel.

The use of a gimp to secure the casket dish in the lid often results in misalignment of the dish and an uneven appearance in locations along the channel where the gimp is improperly seated. The problems associated with using a system of the type described above are multiplied when it is realized that it is often desirable to change the interior of a casket prior to use. Once installed in the casket, the interior (including the fabric-lined dish) must be removed and the new interior installed by a funeral director or other representative. While attempts have been made to eliminate the need for using a gimp in the insertion of the casket dish, see, e.g., U.S. Pat. No. 3,316,608, or to permit insertion of dish using only retainer clips, see, e.g., U.S. Pat. No. 3,228,085, such attempts have not resulted in an accurate procedure for securely inserting and converting casket lid interiors which can be easily and quickly accomplished with a minimum of cost.

It is, therefore, desirable and an object of the present invention to provide a burial casket having a casket dish which can be accurately aligned and securely inserted into a casket lid.

It is another object of the present invention to provide a burial casket having a casket dish which can be inserted into a casket lid without the use of a gimp.

Yet another object of this invention is to provide a burial casket having a casket dish inserted into a casket lid and presenting a finished, decorative appearance.

Another object of this invention is to provide an improved mounting channel for securing an insert in a corresponding channel.

SUMMARY OF INVENTION

These and other objects are achieved by the present invention, which is directed to a burial casket which incorporates a snap-in casket dish which can be readily inserted into a casket lid without using the traditional gimp or retaining strip. An elongate, flexible channel member having an interior section for receiving the folded flap or tab portion of a casket dish or puffing, is attached to the tab portion. The channel member also has a curved section which functions as a spring, permitting a self-adjusting pressure to be applied against the dish fold when inserted into the interior of the channel member. The channel member, which is constructed to cooperate with and fit into a channel in the rim of the casket cap or lid, has an interior wall with a stop member positioned so that the fold, when inserted into the channel member, abuts the stop member and is held in place thereby. The stop member may be in the form of a cylinder or other shape designed to protrude from the cap rims channel when in place and provide a decorative finish for the casket interior.

After an appropriate number of channel members are attached to the fold sections, the resulting assembly is inserted into a series of cooperating channels in the rim of the casket lid. Alternatively, the channel member can first be inserted into the corresponding channel on the casket lid and the dish inserted directly into the interior section of the channel member. Upon insertion, the dish is held tightly in place without the need for an additional gimp or strip to be press-fitted into the channel by a self-adjusting pressure applied by the spring portion of the channel member. Where two channel members intersect at exposed corners of the casket puffing and lid, they are compound mitred prior to assembly onto the puffing to ensure an accurate and aesthetically pleasing fit.

The channel member of the present invention may be provided with one or more protrusions, ribs or barbs on the exterior thereof. These ribs accomodate a secure fit when the channel members with the dish in place are inserted into the cooperating cap rim channel.

The channel member of the present invention may be employed in any situation where it is necessary or desired to secure an insert into a channel, and thus has applicability beyond burial caskets.

The improved burial casket of the present invention comprises a casket body having a casket lid removably attached thereto. The casket lid has a casket lid channel formed in the interior rim thereof.

A mounting channel member is inserted in said casket lid channel and generally conforms to said casket lid channel. The mounting channel has a generally rigid, decorative stop member along one edge thereof and adjacent to one outer edge of said casket lid channel. The mounting channel also has a spring member along the outer edge thereof.

A flexible casket dish is configured to generally conform to the interior of the casket lid and has extended portions removably secured in the mounting channel member in the casket lid channel. The extending portions comprise a creased flat member at the end of which abuts the stop member and which is held in place thereby. The flap member is secured in the mounting channel member and held in position against the generally rigid stop member by the action of the spring member. In this fashion, the casket lid channel and the creased flap member of the dish are hidden from view by the decorative stop member.

The mounting channel member may be, e.g., generally U-shaped.

THE DRAWINGS

The objects and advantages of the present invention will become apparent from the following detailed description of the preferred embodiments thereof, in connection with the accompanying drawings in which like numerals designate like elements, and in which.

DETAILED DESCRIPTION OF PREFERRED EMBODIMENTS OF THE INVENTION

Figure 4:
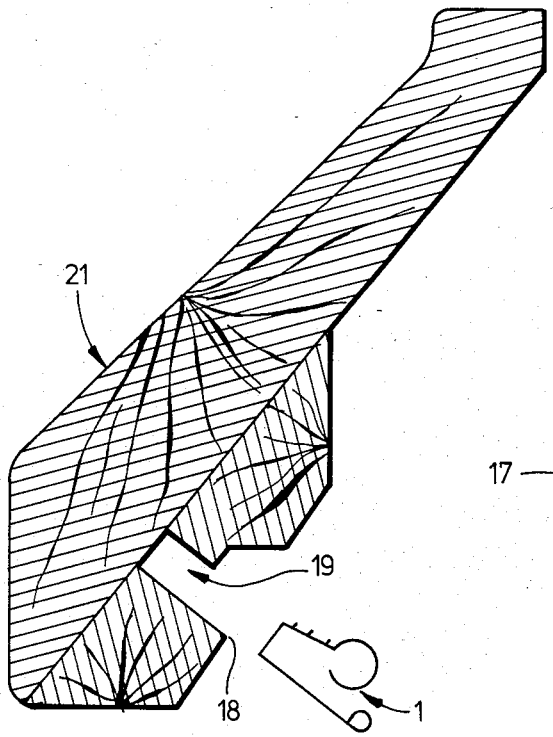
FIG. 4 is a side elevational view of another embodiment of the casket cap rim showing the channel member prior to insertion of another embodiment of the casket dish and insertion into the cap rim channel.
Figure 5:
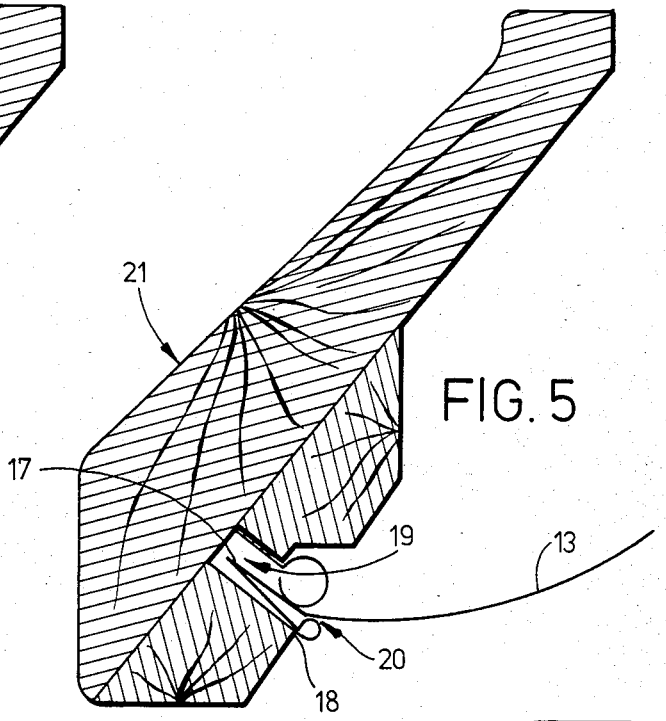
FIG. 5 is a side elevational view of the casket cap rim of FIG. 4 showing the channel member and cap dish inserted into the cap rim channel.
Figure 6B:
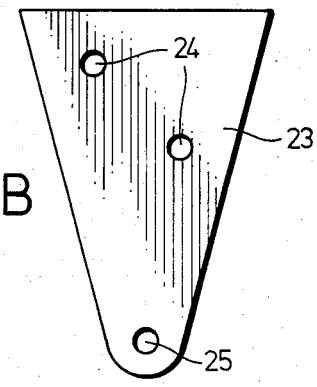
FIG. 6B is a front elevational view of the casket cap brace shown in FIG. 6A.
Figure 6A:
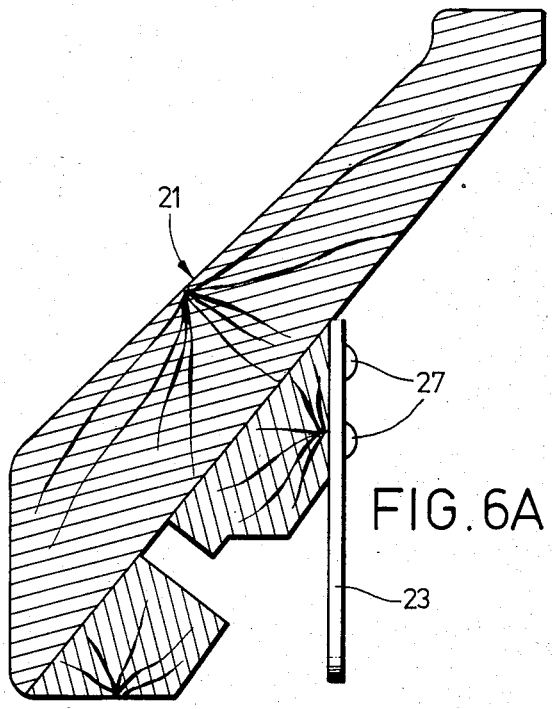
FIG. 6A is a side elevational view of the casket cap rim with a casket cap brace attached.
Figure 7:
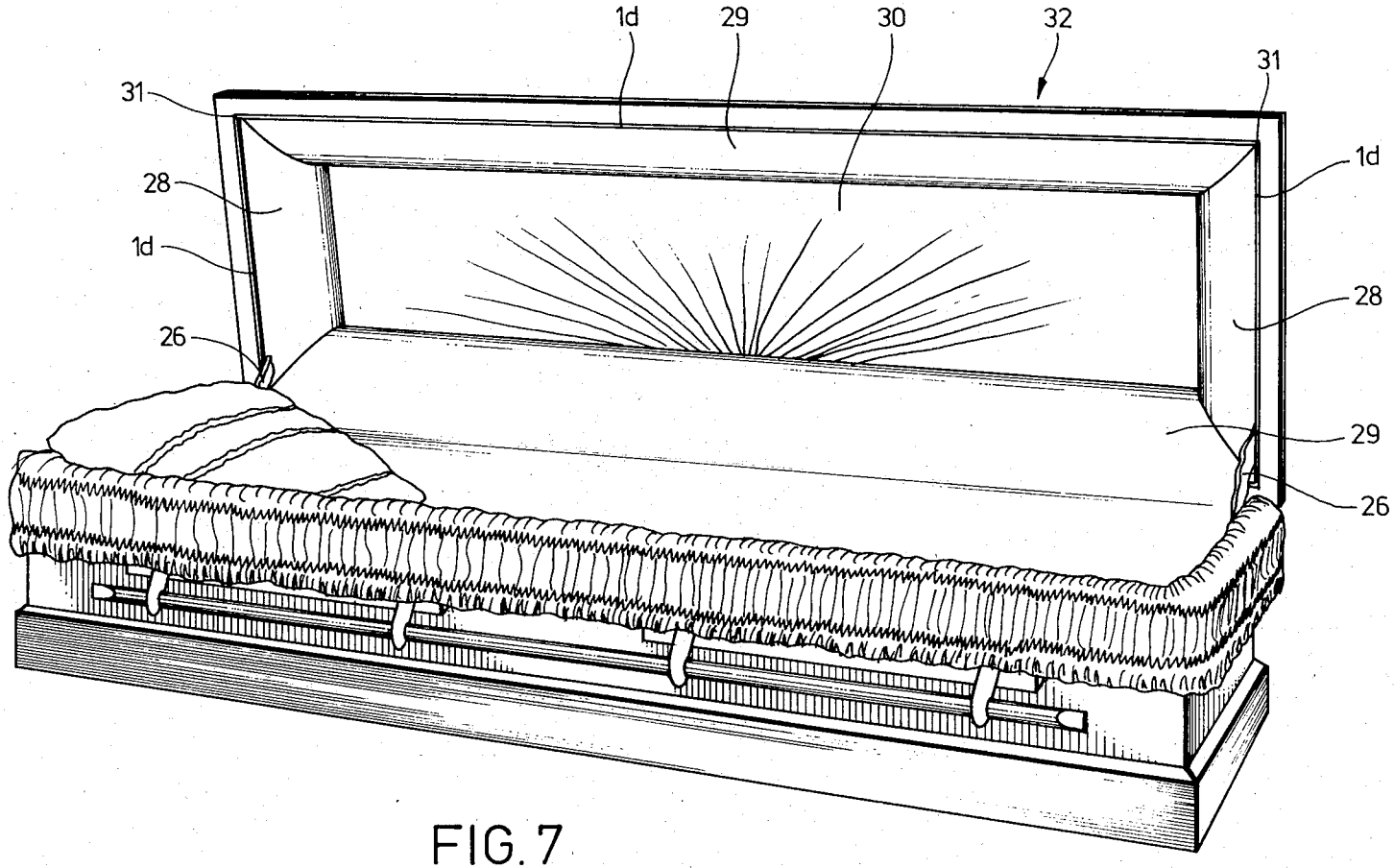
FIG. 7 is a perspective view of a burial casket according to the present invention.

In accordance with the present invention, there is provided an improved burial casket, an improved mounting channel member for inserting a casket dish into a casket lid and retaining the dish in the lid, and an improved method for mounting a casket dish into a casket lid and retaining the same therein. The improved channel member is shown in FIGS. 1 through 5 and 7 in various aspects of use. FIGS. 6A and 6B depict a casket cap brace which may be employed in connection with the present invention and which is described in further detail herein. FIG. 7 depicts an improved casket according to the present invention.

Figure 1:
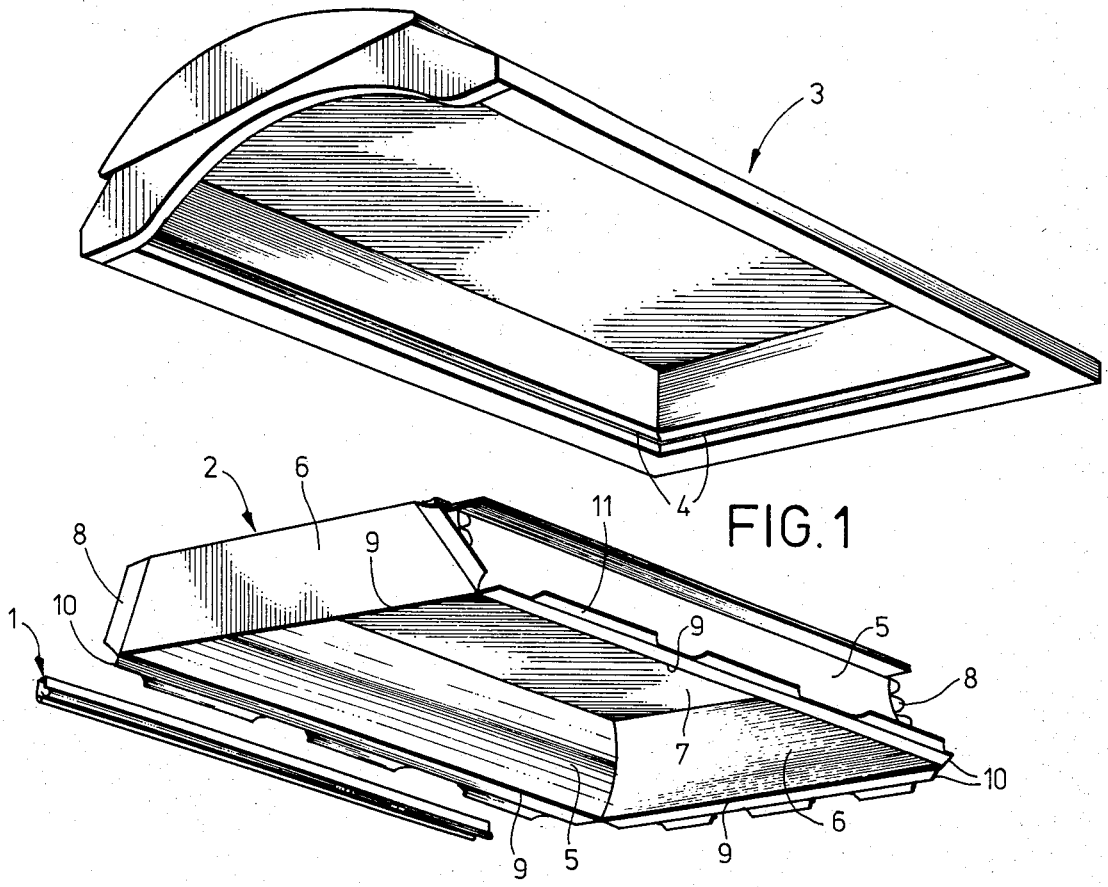
FIG. 1 is an exploded perspective view of the head end of a lid of a burial casket according to the present invention.

Referring to FIG. 1, the channel member of the present invention is generally depicted at 1. The casket dish to which decorative upholstered material is typically attached and which is subsequently mounted or inserted into a casket lid is generally depicted at 2. The casket lid into which the dish, with the channel member of the present invention attached, is inserted is generally depicted at 3. A cooperating channel 4 is located in the rim of burial casket cap or lid 3 for receiving the improved channel member 1 of the present invention either after it has been attached to casket dish 2 or prior to inserting the dish into the channel member already in place in the cooperating channel. FIG. 1 of the present invention depicts a typical head section of a casket lid and FIG. 2, discussed below, depicts a typical foot end section of a casket lid.

Referring again to FIG. 1, the casket dish 2 is constructed of side walls 5, end walls 6 and a floor or bottom section 7. Side walls 5, end walls 6 and floor section 7 are typically attached to each other by securing the same along their edges, e.g., by stapling or gluing. Flaps or tabs 8 may be provided for this purpose. Along the open edges or lips 9 of casket dish 2, extended portions are provided for insertion into the interior section of the channel member 1 to mount the casket dish 2 to the channel member. Typically, these extended portions 10 comprise a creased flap member running the length of the lip. The flap member typically has tab portions 11 extending from the crease or fold line. Alternatively, extended portions 10 may be provided intermittently along one or more lips 9 of the casket dish 2. The particular configuration of the extended portions 10 may vary according to the present invention, so long as the extended portions are constructed to interact with channel member 1 upon insertion into the interior section thereof.

Figure 2:
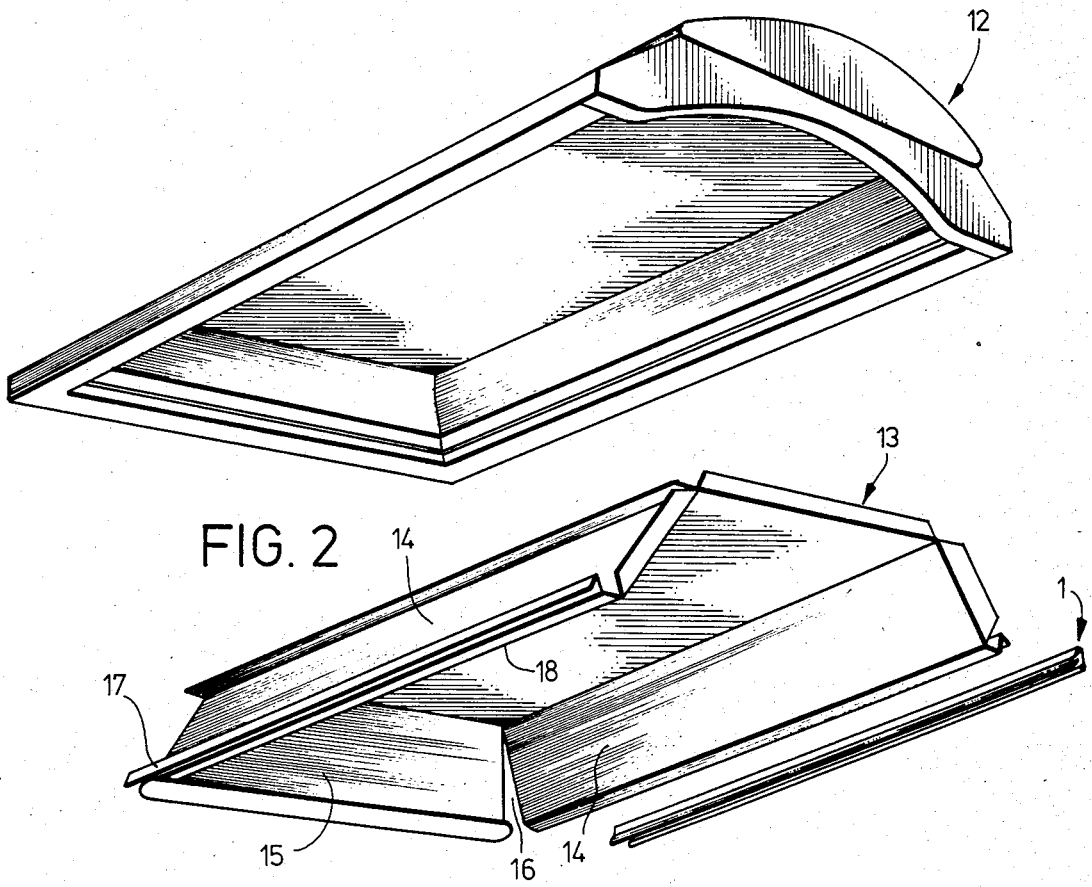
FIG. 2 is an exploded perspective view of the foot end of a lid of a burial casket according to the present invention.

Referring to FIG. 2, the channel member 1 of the present invention is shown located adjacent the foot end section 12 of a burial casket cap or lid. Also depicted in FIG. 2 is another embodiment of a typical casket dish employed in the present invention. In this embodiment, the casket dish 13 consists of a single piece of material which has been folded and cut to form an appropriate dish-shaped member. In this embodiment, the dish typically consists of side members 14 and one end member 15. Side members 14 may be attached to end member 15 at 16 or may be left open, in which case the end portions of end member 15 and side members 14 will abut upon insertion into the casket lid. In the embodiment of the casket dish shown in FIG. 2, the extended section 17 adjacent lip 18 of the dish comprises a single, generally rectangular member having two oppositely directed folds therein, the folds being generally parallel to the lip 18.

Figure 3A:
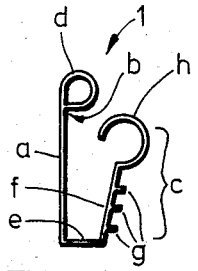
FIG. 3A is a side elevational view of the channel member which is to be attached to the casket dish, according to the present invention.

Refering to FIG. 3A, the channel member of the present invention is generally depicted at 1. The channel member comprises a wall a having a stop member b located at one end thereof. The stop member b may be any suitable protrusion extending from the end of wall a in the general direction of section c of channel member 1. In the embodiment shown in FIG. 3A, stop member b comprises the end portion of a curved extension of wall a. Wall a, which is typically generally planar, has an end portion d which is generally cylindrical in shape, with stop member b comprising the end portion of extension d as it abuts back onto the generally planar portion of wall member a. Wall member a may comprise more than one section, said sections being at slight angles to each other. Extended portion d serves as a decorative bead when the channel member 1 and casket dish are inserted into the casket cap or lid. When inserted, the decorative bead d may be flush with or protruding slightly from the outer edge 18 of the cooperating channel 19 as shown in FIG. 4 discussed below. When inserted into the casket cap, decorative bead d abuts the decorative or upholstered portion of the casket dish as it is inserted into channel member 1 at location 20 as shown in FIG. 5 discussed below.

Returning to FIG. 3A, channel member 1 has a second wall member having a plurality of sections. Section e is a generally planar, rectangular wall which is generally perpendicular to wall member a and which forms a cooperative fit in the bottom of channel 19, as shown in FIGS. 4 and 5. Section e adjoins wall member a at the opposite end of wall member a from the end where stop member b is located. Section f adjoins section e at the end opposite where section e adjoins wall number a. Section f is a generally planar, rectangular wall member oriented generally in the direction of wall member a but is typically skewed at an acute angle slightly away from the plane of wall member a. Protrusions, ribs or barbs g may be located on the exterior face of wall section f. These ribs cooperate with the interior walls of channel 19 to ensure a tight fit when the channel member with the casket dish attached is inserted into the cooperating cap rim channel. Protrusions, ribs or barbs g may be of any suitable size, shape or pattern.

Figure 3B:
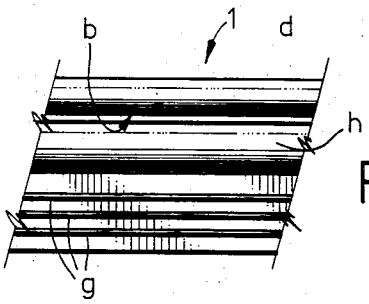
FIG. 3B is a front elevational view of a section of the channel member which is to be attached to the casket dish, according to the present invention.

Extending from the end of wall section f opposite to the end where wall section f abuts wall section e is a spring member h. Spring member h, shown in FIG. 3A as a "C"-shaped, curved member, may be of any suitable shape capable of applying a self-adjusting pressure against the fold 17 as shown in FIGS. 2 and 5. When the fold portion 17 of FIGS. 2 and 5 (or extended section 10 of FIG. 1) is inserted into the interior section of channel member 1, one portion of the fold abuts wall member a at stop b and at wall e. In this manner, the fold is locked or secured into channel member 1. The channel member 1, so secured, is inserted into cooperating channel 19 of the cap rim. As it is inserted, spring member h and wall f move in the general direction of wall a whereby spring member h is brought into abutting contact with one portion of the fold. In this manner, spring member h applies a pressure against the puffing fold. This pressure is self-adjusting in the sense that spring member h and wall member f are free to move in the direction of wall member a in a pressure-applying manner in an amount equal to that necessary to securely insert channel member 1 into corresponding channel 19. As channel member 1 is inserted into corresponding channel 19, ribs g move into contact with one or more walls of corresponding channel 19 to assist in securing channel member 1 in corresponding channel 19. FIG. 3B is a front elevational view of a portion of the channel member 1 described in detail above in connection with FIG. 3A.

Alternatively, the channel member 1 may be inserted into the cooperating channel on the casket lid prior to insertion of the casket dish. The channel member 1 may, if desired, be attached to the cooperating lid channel by means of fasteners, e.g., staples, or by adhesives. In this embodiment, the casket dish is inserted into the channel and channel member 1 and the spring member h applies a self-adjusting pressure as the dish is inserted into the interior section of the channel member.

The mounting channel member 1 may be constructed, e.g., as a unitary part, e.g., an extrusion. The member 1 may be constructed of any suitable material, e.g., polyvinylchloride, ABS, styrene or any other flexible plastic or other material.

FIGS. 4 and 5 show the burial casket cap or lid rim generally depicted at 21. In FIG. 4, channel member 1 is shown prior to insertion of the dish 22, and in particular the fold section 17, into the channel member and subsequently into corresponding channel 19. FIG. 5 shows the channel member with dish 22 and fold 17 in place, inserted into cooperating channel 19.

FIG. 6A shows a casket cap brace 23 mounted to a portion of a casket lid rim. The cap brace, which may be of any suitable shape, is shown in detail in FIG. 6B. In FIG. 6B, cap brace 23 is generally triangular in shape and comprises a plurality of holes 24 for mounting the cap brace 23 to cap rim 21. Another hole 25 is shown for mounting the cap brace to a cap bracket 26, shown in FIG. 7. Casket cap brace 23 is mounted to casket rim 21 by fastening members 27, which are inserted through holes 24. Another fastening member (not shown) is employed to connect the cap brace 23 to cap bracket 26. An opening (not shown) is located in the casket dish for accomodating insertion of the dish over the cap brace 23. Since cap brace 23 is typically mounted onto cap rim 21 prior to insertion of the dish, this opening is required to allow cap brace 23 to protrude therethrough. Subsequent to insertion of the dish, the cap brace 23 may be attached to cap bracket 26. Cap bracket 26 is attached at its other end to the main body of the burial casket.

FIG. 7 depicts an improved casket according the the present invention. In FIG. 7, an upholstered, finished dish is shown with end walls 28, side walls 29 and bottom section 30. The decorative bead portion d of channel 1 is shown in place protruding from the casket rim. The channel member 1 is compound mitred at corners 31 to provide an aesthetically pleasing decorative fit. Burial casket cap or lid 32, as shown in FIG. 7, is a full body cap or lid, as opposed to the half-body cap or lid depicted in FIGS. 1 and 2. In the embodiment shown in FIG. 7, casket lid 32 serves the same function as casket foot and head sections 3 and 12 in FIGS. 1 and 2 combined. It should be noted that in this or in any embodiment of the present invention, channel member 1 may extend the entire length of each section of the casket cap rim, or may extend only to some portion of a section thereof.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. An improved burial casket comprising:

(A) A main casket body;

(B) A casket lid removably attached to said casket body and having a casket lid channel formed in the interior rim thereof;

(C) A mounting channel member inserted in said casket lid channel and generally conforming to said casket lid channel, said mounting channel member having a pair of opposed edges, one of said opposed edges being adjacent to one outer edge of said casket lid channel and comprising a generally rigid, decorative stop member, said other opposed edge comprising a spring member thereof and adjacent to another outer edge of said casket lid channel and (D) A flexible casket dish configured to generally conform to the interior of said casket lid and having extending portions removably secured in said mounting channel member having free end, in said casket lid channel, said extending portions comprising a creased flap member the free end of which abuts said stop member and is held in place thereby, said flap member being secured in said mounting channel member and held in position against said generally rigid stop member by the action of said spring member whereby said casket lid channel and said creased flap member of said dish are hidden from view by said decorative stop member.

2. an improved burial casket according to claim 1 wherein said spring member of said mounting channel is "C"-shaped and opens in the direction of the said stop member.

3. An improved burial casket according to claim 1 wherein said mounting channel member further comprises one or more protrusions abutting said casket lid channel, said protrusions being capable of cooperating with said casket lid channel to secure said mounting channel member to said casket lid channel.

4. Improved burial casket according to claim 1 wherein said mounting channel member is generally U-shaped and wherein said stop member is a curved, generally cylindrical member.

5. An improved burial casket according to claim 1 wherein said mounting channel member comprises a unitary extrustion.

6. An improved burial casket according to claim 3 wherein said unitary extrusion is constructed of polyvinylchloride.

* * * * *